United States Patent [19]

Fang

[11] 4,219,372

[45] Aug. 26, 1980

[54] HOMOGENIZATION OF ZIRCONIUM ALLOYS

[75] Inventor: Michael S. Fang, Albany, Oreg.

[73] Assignee: Teledyne Industries, Inc., Los Angeles, Calif.

[21] Appl. No.: 970,972

[22] Filed: Dec. 19, 1978

Related U.S. Application Data

[63] Continuation-in-part of Ser. No. 873,691, Jan. 30, 1978, abandoned.

[51] Int. Cl.[2] ..... C22F 1/18

[52] U.S. Cl. ..... 148/133; 75/177; 148/11.5 F; 148/32

[58] Field of Search ..... 148/11.5 F, 32, 32.5, 148/133; 75/177

[56] References Cited

U.S. PATENT DOCUMENTS

| | | | |
|---|---|---|---|
| 2,894,866 | 7/1959 | Picklesimer | 148/133 |
| 3,645,800 | 2/1972 | Mock et al. | 148/11.5 F |
| 3,689,324 | 9/1972 | Wiener et al. | 148/11.5 F |
| 3,884,728 | 5/1975 | Levy | 148/133 |

FOREIGN PATENT DOCUMENTS

| | | | |
|---|---|---|---|
| 2422578 | 11/1974 | Fed. Rep. of Germany | 75/177 |

*Primary Examiner*—L. Dewayne Rutledge
*Assistant Examiner*—Peter K. Skiff
*Attorney, Agent, or Firm*—Shoemaker and Mattare, Ltd.

[57] ABSTRACT

A process for homogenizing zirconium alloys and minimizing metallurgical effects of certain alloy and impurity segregates, including tin rich segregates. The zirconium alloys are heated to high temperatures for sufficient time to cause the rich tin stringers or segregates to homogenize in the zirconium alloys.

4 Claims, 1 Drawing Figure

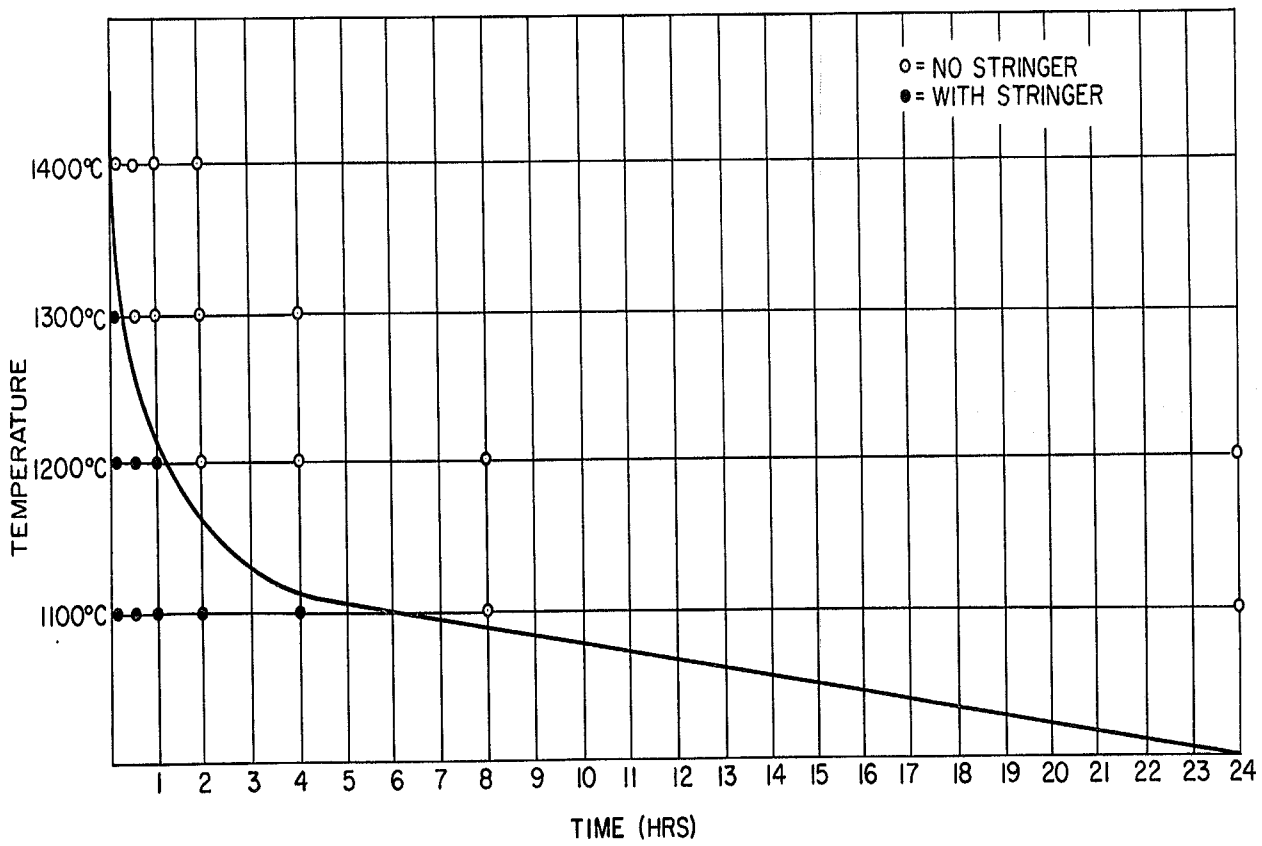
o = NO STRINGER
● = WITH STRINGER
1400°C
1300°C
1200°C
1100°C
TEMPERATURE
1 2 3 4 5 6 7 8 9 10 11 12 13 14 15 16 17 18 19 20 21 22 23 24
TIME (HRS)

HOMOGENIZATION OF ZIRCONIUM ALLOYS

BACKGROUND OF THE INVENTION

This application is a continuation-in-part application of Ser. No. 873,691, filed Jan. 30, 1978, now abandoned.

1. Field of the Invention

This invention relates to minimizing certain alloy and impurity segregates including tin rich segregates in zirconium alloys by means of a heat treatment. More specifically, it deals with tin rich stringer type alloy segregates in wrought zirconium alloys.

2. Description of the Prior Art

In Metallurgy, the term "stringer" is often used to describe "stringlike" features in the microstructure. They can be alloy segregation, second phase particle segregation and/or impurity segregation. In zirconium alloys, no exception to other metal alloy systems, the term "stringer" has been used to describe "stringlike" second phase particles, as, for instance, the stringers described in Picklesimer U.S. Pat. No. 2,894,866, and "stringlike" impurities such as Carbon, Phosphorus, and Silicon, etc. The present case deals with stringers which had long believed to be carbon rich. Because of this belief and the known limited solubility of carbon in zirconium, homogenization by heat treatment seemed impossible and no known attempt to homogenize by this method had been performed.

With recent advancement in electronic analysis techniques, the once believed to be carbon stringer was found to be tin rich. It is believed that these tin rich stringers are products of nonhomogeneity in the vacuum arc melting process. These tin rich segregates appear as irregular shape blobs or something less than an elongated configuration in the cast ingot. As the ingot is worked or wrought, the segregates become elongated in the direction of working and appear as stringlike features when examined parallel to the working direction.

With the knowledge that these stringers are tin rich and the relatively high solubility of tin in zirconium, it is then possible to envision that a heat treatment for the purpose of homoginization would work.

The Picklesimer U.S. Pat. No. 2,894,866 discloses a method of removing second phase segregation type stringers for zirconium based alloys by a heat treatment process. This patent describes the process whereby the alloy is Betaquenched at a temperature of 975° C. for 1 hour. With this treatment, the second phase will redistribute but the tin rich stringers will remain in the microstructure. Other patents dealing with heat treatment of zirconium alloys are Mock U.S. Pat. No. 3,645,800, and Wiener et al Pat. No. 3,689,324, which disclose heat treatments which are either at too low of a temperature or for too short a period of time to remove the tin rich stringers in this case.

Because of the presence of these tin rich stringers, it has been found that in certain uses, corrosion will develop at the sites of these segregates or stringers and, further, that mechanical weaknesses have developed at these sites. In certain forming processes, particularly where sharp bend radii result, the segregates will cause cracking and produce an undesirable product.

It is obvious that a method of removing the tin rich stringers or segregates is needed so that a zirconium product less subject to corrosion and cracking can be produced.

BRIEF SUMMARY OF THE INVENTION

It is, accordingly, one object of the present invention to provide a process to produce zirconium alloy products free of effects from tin rich stringer segregates.

Another object of the present invention is to provide a process whereby zirconium alloys can be heat-treated to minimize or remove tin rich stringers at any stage of processing from ingot pre-heat to final size.

An additional object of the present invention is to provide a process of heat treating zirconium alloys at high temperatures above about 1100° C. for a period of time sufficient to homogenize the tin rich stringers.

A still further object of the present invention is to provide a process whereby any size configuration of zirconium or alloy thereof can be treated to remove tin rich stringer.

Another object of the present invention is to produce a zirconium alloy relatively free of stringer type alloy segregates.

These and other advantages of the present invention will become apparent from the following description and drawing.

In accordance with the above objects, it has been found that the tin rich alloy segregates will remain in zirconium alloys subsequent to Beta-quenching. In accordance with this discovery, it has been further found that these tin rich segregates can be homogenized in the zirconium alloy by high temperature heat treatment for specified periods of time. The temperatures at which the alloy is treated are higher than normally used even in Beta-quenching and are applied for longer periods of time than normally required for that thermal treatment, sometimes as much as 8 to 24 hours. The time of treatment is inversely proportional to the increase in the temperature used. The zirconium alloy can be treated in this way at almost any stage of production from ingot pre-heat to final size. As the thickness of the segregate increases the temperature will have to be higher and/or applied for a longer period of time.

DESCRIPTION OF THE PREFERRED EMBODIMENTS

It has been found that by heat treating zirconium alloys for longer periods of time at higher than normal thermal treatment temperatures, one can reduce tin rich stringers in the product. It has further been found that this heat treatment is successful when applied in accordance with the following equation.

$$[\text{Temp. °C}] \geqq 1225-70 \ln[\text{Time}] \text{ for } [\text{Temp.}] \geqq 1000° \text{ C.}$$

By zirconium alloys is meant those in which the following constitute the major alloying elements:

| | | |
|---|---|---|
| Sn | Trace to 3% | by weight |
| Fe | Trace to 0.3% | by weight |
| Cr | Trace to 0.15% | by weight |
| Ni | Trace to 0.1% | by weight |
| C | Trace to 0.05% | by weight |
| O | Trace to 0.2% | by weight |
| Si | Trace to 0.03% | by weight |
| Zr | Balance | by weight |

By treating the above alloys at temperatures above 1100° C., in accordance with the above formula, these stringer type alloy segregates will be caused to homogenize in the zirconium alloy. This will then produce an alloy with greater corrosion resistance and formability. A typical example of time and temperature used on an 0.08" thick sheet of a wrought zirconium alloy having a tin stringer of a thickness of about 0.1 to 1 micron is as follows:

| Temp. | 10min. | ½hr. | 1hr. | 2hrs. | 4hrs. | 8hrs. | 24hrs. |
|---|---|---|---|---|---|---|---|
| 1400° C. | N | N | N | N | — | — | — |
| 1300° C. | S | N | N | N | N | — | — |
| 1200° C. | S | S | S | N | N | N | N |
| 1100° C. | S | S | S | S | S | N | N |

N = no stringer
S = stringer

In the sole FIGURE in the case, the above points were plotted on a graph as shown therein and the line defining the area above which the segregates are removed is represented by the formula set forth above.

Since final segregate size to be homogenized is dependent upon both the initial size in the as-cast ingot and the amount of work subsequently performed during its reduction to the dimensions at which it is to be thermally treated, it is possible, then, for thicker segregates to exist in a material that has received greater reduction by working than a comprable piece from a different starting ingot.

Time and temperature calculated according to the above formula will provide a guideline for proper parameters for removing tin stringers from any size zirconium alloy product. As an instance, a 4" thick zirconium alloy plate was desegregated (tin stringer homogenized) by treating at 1200° C. for 4 hours.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalent are, therefore, intended to be embraced by those claims.

I claim:

1. A method of minimizing or relatively reducing alloy and impurity segregates including tin rich segregates in zirconium alloys containing an effective amount of tin to form tin rich segregates comprising heating the alloy to a sufficient temperature for a sufficient time to homogenize the segregates into the zirconium alloy, said time and temperature being determined by the following formula:

$$[\text{Temp.}^\circ\text{C.}] \geqq 1225-70 \ln[\text{Time}] \text{ for } [\text{Temp}] \geqq 1000^\circ \text{ C.}$$

2. The process of claim 1 wherein the zirconium alloy has the following composition:

| | | |
|---|---|---|
| Sn | Trace to 3% | by weight |
| Fe | Trace to 0.3% | by weight |
| Cr | Trace to 0.15% | by weight |
| Ni | Trace to 0.1% | by weight |
| C | Trace to 0.05% | by weight |
| O | Trace to 0.2% | by weight |
| Si | Trace to 0.03% | by weight |
| Zr | Balance | by weight |

3. A process of minimizing or relatively reducing tin rich stringer type alloy segregates of an initial thickness of about 0.1 to 1 micron in zirconium alloys containing an effective amount of tin to form tin rich segregates comprising heating said zirconium alloy at a temperature of from 1100° C. to 1400° C. for a time of from eight hours to ten minutes, respectively.

4. A wrought zirconium alloy containing tin heat treated so as to be free from tin rich stringer type alloy segregates.

* * * * *